US012768001B2

(12) United States Patent
Kim et al.

(10) Patent No.: US 12,768,001 B2
(45) Date of Patent: Oct. 20, 2026

(54) HIGH-STRENGTH STEEL SHEET HAVING EXCELLENT IMPACT RESISTANCE, AND METHOD FOR MANUFACTURING SAME

(71) Applicant: POSCO CO., LTD, Pohang-si (KR)

(72) Inventors: Sung-Il Kim, Gwangyang-si (KR); Seok-Jong Seo, Gwangyang-si (KR)

(73) Assignee: POSCO CO., LTD, Gyeongsangbuk-Do (KR)

( * ) Notice: Subject to any disclaimer, the term of this patent is extended or adjusted under 35 U.S.C. 154(b) by 548 days.

(21) Appl. No.: 18/196,261

(22) Filed: May 11, 2023

(65) Prior Publication Data

US 2023/0279518 A1 Sep. 7, 2023

Related U.S. Application Data

(62) Division of application No. 16/955,648, filed as application No. PCT/KR2018/014267 on Nov. 20, 2018, now Pat. No. 11,708,623.

(30) Foreign Application Priority Data

Dec. 22, 2017 (KR) ..... 10-2017-0178856

(51) Int. Cl.
*C21D 9/46* (2006.01)
*C21D 8/02* (2026.01)
(Continued)

(52) U.S. Cl.
CPC ..... *C21D 9/46* (2013.01); *C21D 8/02* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/32* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS 6,228,183 B1 5/2001 Bangaru
2011/0186189 A1 8/2011 Futamura
(Continued)

FOREIGN PATENT DOCUMENTS

CA 2931494 A1 6/2015
CN 102884217 A 1/2013
(Continued)

OTHER PUBLICATIONS

International Search Report dated Feb. 22, 2019 issued in International Patent Application No. PCT/KR2018/014267 (along with English translation).
(Continued)

*Primary Examiner* — Anthony M Liang
(74) *Attorney, Agent, or Firm* — Morgan Lewis & Bockius LLP

(57) ABSTRACT

The present invention relates to material utilized for heavy construction machinery, vehicle frames, reinforcing members, and the like, and more specifically to a high-strength steel sheet having excellent impact resistance and a method for manufacturing same.

7 Claims, 1 Drawing Sheet

(51) Int. Cl.

| | |
|---|---|
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/32*** | (2006.01) |

(56) References Cited

U.S. PATENT DOCUMENTS

| | | | |
|---|---|---|---|
| 2013/0039803 | A1 | 2/2013 | Takaoka et al. |
| 2014/0377584 | A1 | 12/2014 | Hasegawa et al. |
| 2016/0017466 | A1 | 1/2016 | Shibata et al. |
| 2017/0130293 | A1 | 5/2017 | Kaneko et al. |
| 2017/0260602 | A1 | 9/2017 | An et al. |
| 2018/0023154 | A1 | 1/2018 | Hasegawa et al. |
| 2018/0119240 | A1 | 5/2018 | Tanaka |
| 2018/0209006 | A1 | 7/2018 | Toda et al. |
| 2019/0032186 | A1 | 1/2019 | Ueno |

FOREIGN PATENT DOCUMENTS

| | | | |
|---|---|---|---|
| CN | 107164695 | A | 9/2017 |
| EP | 2757171 | A1 | 7/2014 |
| JP | 2000-109951 | A | 4/2000 |
| JP | 2003-089848 | A | 3/2003 |
| JP | 2003-105446 | A | 4/2003 |
| JP | 2003-321737 | A | 11/2003 |
| JP | 2006-183141 | A | 7/2006 |
| JP | 2007-009325 | A | 1/2007 |
| JP | 2012-031462 | A | 2/2012 |
| JP | 2016-204690 | A | 12/2016 |
| KR | 10-2012-0132835 | A | 12/2012 |
| KR | 10-2013-0013545 | A | 2/2013 |
| KR | 10-2014-0131712 | A | 11/2014 |
| KR | 10-2015-0007607 | A | 1/2015 |
| KR | 10-2015-0007608 | A | 1/2015 |
| KR | 10-2015-0122779 | A | 11/2015 |

OTHER PUBLICATIONS

U.S. Notice of Allowance dated Mar. 24, 2023 issued in U.S. Appl. No. 16/955,648.

U.S. Final Office Action dated Oct. 17, 2022 issued in U.S. Appl. No. 16/955,648.

U.S. Non-Final Office Action dated Jun. 23, 2022 issued in U.S. Appl. No. 16/955,648.

U.S. Final Office Action dated Feb. 9, 2022 issued in U.S. Appl. No. 16/955,648.

U.S. Non-Final Office Action dated Oct. 26, 2021 issued in U.S. Appl. No. 16/955,648.

Japanese Office Action dated Jun. 29, 2021 issued in Japanese Patent Application No. 2020-534952.

Extended European Search Report dated Sep. 11, 2020 issued in European Patent Application No. 18890765.3.

Chinese Office Action dated Mar. 24, 2021 issued in Chinese Patent Application No. 201880079878.5.

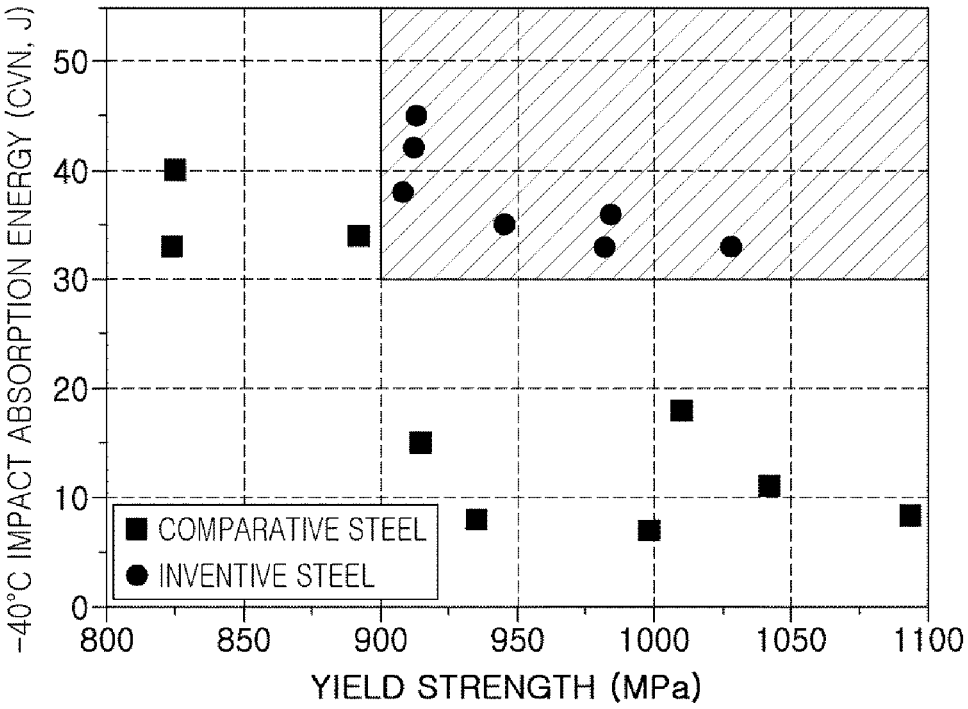
-40°C IMPACT ABSORPTION ENERGY (CVN, J)
50
40
30
20
10
0
800
850
900
950
1000
1050
1100
YIELD STRENGTH (MPa)
COMPARATIVE STEEL
INVENTIVE STEEL

HIGH-STRENGTH STEEL SHEET HAVING EXCELLENT IMPACT RESISTANCE, AND METHOD FOR MANUFACTURING SAME

CROSS-REFERENCE OF RELATED APPLICATIONS

This application is a divisional of U.S. patent application Ser. No. 16/955,648, filed on Jun. 18, 2020, which is the U.S. National Phase under 35 U.S.C. § 371 of International Patent Application No. PCT/KR2018/014267, filed on Nov. 20, 2018, which in turn claims the benefit of Korean Patent Application No. 10-2017-0178856, filed on Dec. 22, 2017, the entire disclosures of which applications are incorporated by reference herein.

TECHNICAL FIELD

The present invention relates to material utilized for heavy construction machinery, vehicle frames, reinforcing members, and the like, and more specifically to a high-strength steel sheet having excellent impact resistance and a method for manufacturing same.

BACKGROUND ART

A high-strength hot-rolled steel sheet is mainly used for a heavy construction machinery boom arm, vehicle frames, and the like, and the hot-rolled steel sheet is required to have high yield strength, bending formability, and impact resistance characteristics simultaneously, to suit the manufacturing process and use environment of the component. Accordingly, there are a number of techniques for simultaneously improving the strength and formability of the hot-rolled steel sheet. As an example, it has been proposed in a technique for manufacturing steel having high strength and high burring properties made of dual phase composite structure steel of a ferrite-bainite or ferrite-martensite, or a ferrite phase or a bainite phase as a matrix. In addition, a technique for manufacturing a high strength steel having a martensite phase as a matrix by cooling to a room temperature by applying a high cooling rate has been proposed.

Meanwhile, the hot-rolled steel sheet used for the heavy construction machinery, vehicle frames, and the like, in addition to a high yield strength, requires excellent impact characteristics. In particular, considering not only a room temperature but also various working environments and use environments, excellent impact characteristics are required even at low temperatures.

In Patent Document 1, a tensile strength of 950 MPa or higher and a yield ratio of 0.9 or higher by dispersing and precipitating precipitates containing Ti and Mo can be secured, but there is a problem that not only the production cost is increased by adding a large amount of expensive alloying components, and but also the impact resistance characteristic required for the thick hot-rolled steel sheet is not secured.

Meanwhile, Patent Document 2 discloses a technology for providing a high-strength hot-rolled steel sheet using a dual phase (DP) steel of ferrite and martensite. However, in the case of using a step cooling technology, it is difficult to be applied to a hot-rolled steel material made of a thick material, and there has also a problem of increasing manufacturing costs by adding a large amount of expensive alloying components. In addition, because the yield ratio is low due to the characteristics of the composite structure steel, an excessively high tensile strength and a large amount of alloying elements are required to satisfy the desired yield strength.

In order to manufacture a high-strength hot-rolled steel sheet, Patent Document 3 discloses a technology for controlling the cooling rate at a high speed exceeding 150° C./sec after the hot rolling is finished. However, in the case of manufacturing martensite by cooling at too fast cooling rate, the yield ratio is low, so it is difficult to secure a high yield strength, and a high tensile strength is required to satisfy the yield strength standard, resulting in deterioration in impact characteristics and formability.

Patent document 4 discloses a technology of controlling a coiling temperature to 300 to 550° C. As in Patent Document 4, when coiled at 300° C. or higher, the formation of a bainite structure causes the microstructure to approximate an equiaxed crystal having a low shape ratio, which is advantageous for formability, but impact resistance is deteriorated. In addition, it is difficult to control a precise coiling temperature, and material deviation may be severe, according to the tendency of the material to depend on the coiling temperature, and if the coiling temperature is increased to manage the material deviation, there is a problem that an addition of a large amount of alloying elements is required to secure the strength.

(Patent Document 1) Japanese Patent Application No. 2003-089848

(Patent Document 2) Japanese Patent Application No. 2003-321737

(Patent Document 3) Japanese Patent Application No. 2003-105446

(Patent Document 4) Japanese Patent Application No. 2000-109951

DISCLOSURE

Technical Problem

The present disclosure is to provide a steel sheet having excellent strength and excellent impact characteristics not only at room temperatures but also at low temperatures, and a method for manufacturing the same.

Technical problems to be achieved in the present disclosure are not limited to the technical problems mentioned above, and other technical problems, not mentioned, will be clearly understood by those skilled in the art from the following description.

Technical Solution

An aspect of the present disclosure relates to a high-strength steel sheet having excellent impact resistance, includes, in wt %: 0.05 to 0.12% of C, 0.01 to 0.5% of Si, 0.8 to 2.0% of Mn, 0.01 to 0.1% of Al, 0.005 to 1.2% of Cr, 0.005 to 0.5% of Mo, 0.001 to 0.01% of P, 0.001 to 0.01% of S, 0.001 to 0.01% of N, 0.001 to 0.03% of Nb, 0.005 to 0.03% of Ti, 0.001 to 0.2% of V, 0.0003 to 0.003% of B, and a remainder of Fe and unavoidable impurities, a microstructure includes tempered martensite as a main structure, and a remainder thereof includes one or more of residual austenite, bainite, tempered bainite and ferrite, the number of one or more of carbides and nitrides having a diameter of 0.1 μm or more per circle observed in a 1 $cm^2$ unit area is $1\times10^3$ or less, and the number of precipitates having a diameter of 50 nm or more including one or more of Ti, Nb, V, and Mo observed in a 1 $cm^2$ unit area is $1\times10^7$ or less.

Another aspect of the present disclosure relates to a method of a high-strength steel sheet having excellent impact resistance, includes steps of:

reheating a steel slab including, in wt %: 0.05 to 0.12% of C, 0.01 to 0.5% of Si, 0.8 to 2.0% of Mn, 0.01 to 0.1% of Al, 0.005 to 1.2% of Cr, 0.005 to 0.5% of Mo, 0.001 to 0.01% of P, 0.001 to 0.01% of S, 0.001 to 0.01% of N, 0.001 to 0.03% of Nb, 0.005 to 0.03% of Ti, 0.001 to 0.2% of V, 0.0003 to 0.003% of B, and a remainder of Fe and unavoidable impurities;

hot rolling the reheated steel slab;

after the hot rolling, cooling the hot-rolled steel, and coiling it;

after the coiling, secondary reheating a steel sheet to a temperature of 850 to 1000° C., and maintaining the steel sheet for 10 to 60 minutes;

cooling the heated and maintained steel sheet at a cooling rate of 30 to 100° C./sec to a temperature range of 0 to 100° C.;

heating the cooled steel sheet to a temperature range of 100 to 500° C. and performing a tempering heat treatment for 10 to 60 minutes; and cooling the tempered heat-treated steel sheet at a cooling rate of 0.001 to 100° C./s to a temperature range of 0 to 100° C.

Advantageous Effects

According to the present disclosure, it is possible to provide a steel sheet having excellent strength characteristics and having excellent impact resistance characteristics at low temperatures as well as at room temperatures. Thereby, it can be suitably applied to heavy equipment, commercial vehicle frames, reinforcing members, and the like.

DESCRIPTION OF DRAWINGS

FIG. 1 is a graph showing a yield strength and Charpy impact absorption energy of Inventive steel and Comparative steel in Embodiments.

BEST MODE FOR INVENTION

The present inventors have studied in depth the changes in strength and impact properties of steel sheets according to the characteristics of various alloy components and microstructures that can be applied to steel. As a result, it is recognized that the steel sheet having excellent impact resistance characteristic and strength can be obtained by appropriately controlling an alloy composition range of the hot-rolled steel sheet and optimizing formation of a matrix of a microstructure, carbonitrides, and precipitates, thereby leading to the present invention.

Hereinafter, a steel sheet according to an aspect of the present disclosure will be described in detail. First, the alloy composition range of the steel sheet of the present disclosure will be described in detail.

The steel sheet of the present disclosure preferably includes in wt %, 0.05 to 0.12% of C, 0.01 to 0.5% of Si, 0.8 to 2.0% of Mn, 0.01 to 0.1% of Al, 0.005 to 1.2% of Cr, 0.005 to 0.5% of Mo, 0.001 to 0.01% of P, 0.001 to 0.01% of S, 0.001 to 0.01% of N, 0.001 to 0.03% of Nb, 0.005 to 0.03% of Ti, 0.001 to 0.2% of V, and 0.0003 to 0.003% of B. Hereinafter, with respect to the range of the component range of the alloy, the content of each element is in weight %, unless otherwise specified.

Carbon (C): 0.05 to 0.12%

C is the most economical and effective element to strengthen steel, and when an addition amount of C increases, a fraction of martensite phase or bainite phase increases, thereby increasing tensile strength. When the content of C is less than 0.05%, it is difficult to obtain a sufficient strength strengthening effect, and when it exceeds 0.12%, formation of coarse carbides and precipitates during heat treatment becomes excessive, and there is a problem that formability and low-temperature impact resistance characteristics are lowered, and weldability is also inferior. Therefore, the content of C is preferably 0.05 to 0.12%.

Silicon (Si): 0.01 to 0.5%

Si deoxidizes molten steel and has a solid solution strengthening effect, and is advantageous in improving formability and impact resistance characteristics by delaying the formation of coarse carbides. However, if the content thereof is less than 0.01%, the effect of delaying the formation of carbides is small, making it difficult to improve formability and impact resistance characteristics. On the other hand, when it exceeds 0.5%, a red scale formed by Si is formed on a surface of a steel sheet during hot rolling, so that the surface quality of the steel sheet is very poor and the weldability is also deteriorated. Therefore, the Si content is preferably 0.01 to 0.5%.

Manganese (Mn): 0.8 to 2.0%

Mn, like Si, is an effective element for solid solution strengthening of steel, and increases hardenability of steel to facilitate the formation of martensite to bainite phases in a cooling process after heat treatment. However, if the content thereof is less than 0.8%, the above effects due to addition cannot be sufficiently obtained, and if it exceeds 2.0%, a segregation portion is greatly developed in a center thickness portion during slab casting in a continuous casting process, and a microstructure in a thickness direction during cooling after hot rolling is formed non-uniformly, resulting in poor impact resistance characteristics at low temperatures. Therefore, the content of Mn is preferably 0.8 to 2.0%.

Aluminum (Al): 0.01 to 0.1%

Al is Sol. Al, and Al is a component mainly added for deoxidation. If the content thereof is less than 0.01%, the addition effect is negligible, and when it exceeds 0.1%, AlN is mainly formed in combination with nitrogen, so that it is easy to cause corner cracks in the slab during continuous casting, and defects are caused by inclusion formation. Therefore, the Al content is preferably 0.01 to 0.1%.

Chromium (Cr): 0.005 to 1.2%

Cr serves to solid solution strengthen the steel, delay the ferrite phase transformation upon cooling to help form the martensite phase or bainite phase. However, if the content thereof is less than 0.005%, an additive effect cannot be obtained, and if it exceeds 1.2%, a segregation portion in the thickness center portion is greatly developed, similar to Mn, and the impact resistance properties are inferior at low-temperatures by making the microstructure in the thickness direction non-uniform. Therefore, the Cr content is preferably 0.005 to 1.2%.

Molybdenum (Mo): 0.005 to 0.5%

Mo increases hardenability of steel to facilitate formation of martensite or bainite phases. However, if the content thereof is less than 0.005%, an effect according to addition cannot be obtained, and if it exceeds 0.5%, a precipitate formed during coiling immediately after hot rolling grows coarsely during heat treatment, thereby degrading the impact resistance characteristics at low-temperatures. In addition, it is disadvantageous economically and is also detrimental to weldability. Therefore, the Mo content is preferably 0.005 to 0.5%.

Phosphorous (P): 0.001 to 0.01%

P has a high solid solution strengthening effect, but is an element that causes brittleness due to grain boundary segregation, thereby impairing impact resistance characteristics. If the content of the P is less than 0.001%, manufacturing costs are high, which may be economically disadvantageous. On the other hand, when it exceeds 0.01%, brittleness by grain boundary segregation occurs as described above. Therefore, the content of P is preferably 0.001 to 0.01%.

Sulfur(S): 0.001 to 0.01%

S is an impurity present in steel, and when the content thereof exceeds 0.01%, it is combined with Mn, or the like, to form a non-metallic inclusion, and accordingly, it is easy to cause fine cracks during cutting and processing the steel and greatly decreases impact resistance characteristics. On the other hand, when the content of S in less than 0.001%, it takes a lot of time during steelmaking operation to decrease productivity. Therefore, the content of S is preferably 0.001 to 0.01%

Nitrogen (N): 0.001 to 0.01%

N is a representative solid solution strengthening element together with C and forms coarse precipitates with Ti, Al, and the like. In general, the solid solution strengthening effect of N is better than that of carbon, but it is preferable not to exceed 0.01% because there is a problem that toughness of the steel falls significantly as an amount of N increases. When the content of N is less than 0.001%, it takes a lot of time during the steelmaking operation, and productivity decreases. Therefore, the content of N is preferably 0.001 to 0.01%.

Niobium (Nb): 0.001 to 0.03%

Nb is a representative precipitation strengthening element together with Ti and V, and is effective in improving the strength and impact toughness of the steel due to a grain refinement effect due to recrystallization delay by precipitation during hot rolling. However, when the content of Nb is less than 0.001%, the above effect cannot be obtained, and when it exceeds 0.03%, there is a problem in that low-temperature impact resistance characteristic is inferior by growing as a coarse composite precipitate during heat treatment. Therefore, the content of Nb is preferably 0.001 to 0.03%.

Titanium (Ti): 0.005 to 0.03%

As described above, Ti is a representative precipitation strengthening element together with Nb and V, and forms coarse TiN in the steel due to affinity with N. TiN has an effect of inhibiting growth of crystal grains during a heating process for hot rolling, and it is advantageous to utilize B added to improve hardenability by stabilizing solid solution N. In addition, Ti remaining after reacting with nitrogen is dissolved in the steel and is combined with carbon to form a TiC precipitate, which is a useful element for improving the strength of steel. If the Ti content is less than 0.005%, the above effect cannot be obtained, and if it exceeds 0.03%, there is a problem that low-temperature impact resistance characteristic is inferior due to generation of coarse TiN and coarsening of precipitates during heat treatment. Therefore, the content of Ti is preferably 0.005 to 0.03%.

Vanadium (V): 0.001 to 0.2%

V is a representative precipitation strengthening element together with Nb and Ti, and is effective in improving the strength of steel by forming a precipitate after coiling. If the content of V is less than 0.001%, the above effect cannot be obtained, and if it exceeds 0.2%, low-temperature impact resistance characteristic is inferior due to the formation of coarse composite precipitates, which is also economically disadvantageous. Therefore, the content of V is preferably 0.001 to 0.2%.

Boron (B): 0.0003 to 0.003%

B has an effect of improving hardenability when it is present in steel in a solid solution state, and has an effect of stabilizing grain boundaries to improve brittleness of steel in a low-temperature region. When the content of B is less than 0.0003%, the effect is difficult to be obtained, and when it exceeds 0.003%, recrystallization behavior is delayed during hot rolling, and hardenability is greatly increased, resulting in poor formability. Therefore, the content of B is preferably 0.0003 to 0.003%.

In addition to the above components, the remainder includes Fe and unavoidable impurities. However, addition of other alloying elements is not excluded without departing from the technical spirit of the present disclosure.

Among the above components, Mn forms a segregation zone in the center portion or precipitates MnS, or the like, thereby making the microstructure in the thickness direction non-uniform to significantly reduce impact resistance characteristics. Therefore, the uniformity and impact characteristics of the microstructure can be improved when it is prepared in an appropriate content with Cr and Mo, which are alloying elements having similar hardenability. To this end, in the present disclosure, it is preferable that the contents of the Mn, Cr, and Mo satisfy the following Relational expression 1. In the Relational expression 1, each element indicates the content (% by weight) of each alloy component.

$$T=Mn/(Cr+Mo),\ 1.0\leq T\leq 3.0 \qquad \text{[Relational expression 1]}$$

In the thickness center portion of the steel sheet, material deviation may occur due to segregation of Mn, Cr, and the like. When the condition of the Relational expression 1 is satisfied, the non-uniformity of the microstructure in the thickness direction of the steel decreases, such that the difference in hardness at t/2 and t/4 positions of the thickness t of the steel sheet becomes 30 Hv or less, and excellent impact resistance characteristics at low-temperatures can be improved. Meanwhile, the T value is more preferably 1.0 or more and 2.0 or less.

Meanwhile, when manufacturing high-strength steel, various carbides, nitrides, sulfides, complex precipitates, and the like are formed. When sizes of the carbides, nitrides, sulfides, complex precipitates, and the like are formed coarsely or they are excessively formed, which causes brittle fracture and inferior impact resistance characteristics. In order to solve this problem, the present disclosure, it is preferable that the contents of the Nb, Ti, N, S, V, Mo and C satisfy the following Relational expression 2. In the Relational Expression 2, each element indicates a content (% by weight) of each alloy component.

$$Q=(Nb/93+Ti^*/48+V/51+Mo/96)/(C/12),\ 0.2\leq Q\leq 0.5$$

$$Ti^*=Ti-3.42*N-1.5*S,\ 0\leq Ti^*\leq 0.02 \qquad \text{[Relational expression 2]}$$

Ti* of the Relational Expression 2 may mean surplus remaining Ti after forming sulfides and nitrides. Ti has excellent affinity with N, so Ti is first added to form TiN. If an amount of Ti addition is insufficient or Ti is not added, solid solution N exists in the steel, and B added to improve hardenability and impact resistance characteristic is formed into BN, such that the effect thereof cannot be obtained. In addition, S also forms a complex precipitate together with Ti and C, which is an effective method to reduce MnS, a sulfide that increases the brittleness of steel. Therefore, Ti must be added to stabilize both solid solution N and S.

However, when the Ti is excessively added, the size of precipitate precipitated together with Nb, V, Mo, and the like increases, grows more coarsely during heat treatment, and an effect of improving impact resistance characteristic is lost. In the Relational expression 2, it is necessary to control the contents of Nb, Mo, and V for the same reason.

Meanwhile, if coarse carbides, nitrides, and precipitates are excessively formed even if the above Relational expressions are satisfied, the impact resistance characteristic at low-temperatures is inferior. Therefore, in the steel sheet of the present disclosure, it is preferable that the number of one or more of carbides and nitrides having a diameter of 0.1 μm or more per circle equivalent observed in a unit area of 1 $cm^2$ is $1\times10^3$ or less, and the number of precipitates having a diameter of 50 nm or more including one or more among Ti, Nb, V and Mo observed in a unit area of 1 $cm^2$ is $1\times10^7$ or less.

The carbide is formed during the tempering heat treatment, and when the carbide grows to a coarse size, strength decreases and brittleness increases, so it is desirable to maintain a small size. Meanwhile, a nitride is formed at a high-temperature when a steel slab is manufactured, and the size and distribution thereof are largely dependent on the Ti content and mainly forms a nitride in a form of TiN. When a large amount of this coarse nitride is formed, the strength and brittleness are inferior, so it is preferable that the carbides and nitrides have a diameter of 0.1 μm or more per circle, which is observed in a unit area of 1 $cm^2$, and $1\times10^3$ or less.

Meanwhile, the precipitate is mainly formed during hot rolling, and a small amount of precipitate is also formed in a secondary heat treatment process. When a fine-sized precipitate is formed in a very small amount, it may contribute to structure refinement. To this end, it is preferable that $1\times10^5$ or more fine precipitates having a size of 5 to 50 nm in a unit area of 1 $cm^2$ are formed. However, if the size of the precipitate is large and a large amount of coarse precipitate is formed, it may not contribute to structure refinement and cause deterioration of physical properties. Therefore, it is preferable that the precipitate of 50 nm or more in a unit area of 1 $cm^2$ is $1\times10^7$ or less.

The microstructure of the steel sheet of the present disclosure includes tempered martensite as the main structure, preferably 80% or more in an area fraction. Other than the main structure, residual austenite, bainite, tempered bainite, ferrite, and the like may be included.

In addition, it is preferable that the steel sheet of the steel sheet has a difference in hardness between t/2 and t/4 positions of the thickness t of the steel sheet of 30 Hv or less.

Hereinafter, a method for manufacturing a steel sheet provided by the present disclosure, which is another aspect of the present disclosure, will be described in detail. The method for manufacturing the steel sheet of the present disclosure is not limited to the method described below, which is provided by the present inventors as an example.

The method for manufacturing the steel sheet of the present disclosure includes steps of reheating, hot rolling, cooling and coiling, and then secondary reheating, cooling, and tempering heat treatment, followed by cooling the steel a steel slab satisfying the alloying component and composition range. Hereinafter, each step will be described in detail.

It is preferable to reheat the steel slab to a temperature range of 1200 to 1350° C. When the reheating temperature is less than 1200° C., precipitates are not sufficiently resolved, and coarse precipitates and TiN remain. When a reheating temperature exceeds 1350° C., the strength decreases due to abnormal grain growth of austenite grains, so the reheating temperature is preferably 1200 to 1350° C.

The reheated steel slab is hot-rolled. The hot rolling is preferably performed in a temperature range of 850 to 1150° C. When hot rolling is started at a temperature higher than 1150° C., a temperature of the hot-rolled steel sheet becomes high, the grain size becomes coarse, and a surface quality of the hot-rolled steel sheet deteriorates. On the other hand, when the hot rolling is performed at a temperature lower than 850° C., elongated grains are developed due to excessive a recrystallization delay, resulting in severe anisotropy and deterioration in formability. Therefore, it is preferable to perform the hot rolling at a temperature of 850 to 1150° C.

After the hot rolling, it is preferable to cool at an average cooling rate of 10 to 70° C./sec to a temperature range of 500 to 700° C. When the cooling end temperature is cooled to less than 500° C., local bainite phase and martensite phase are formed in subsequent air cooling, resulting in non-uniformity of a material of a rolled plate and deterioration of shape. When the cooling end temperature exceeds 700° C., a coarse ferrite phase is developed, and when there are many hardenable elements in the steel, a Martensite Austenite Constituent (MA) phase is formed, such that a microstructure is non-uniform and a scale layer is thickly formed on a surface layer to be peeled off in powder form. More preferably, it is cooled to a temperature of 550 to 650° C. In this case, if the cooling rate is less than 10° C./sec, it takes a lot of time to cool to a target temperature, and productivity is deteriorated. If it exceeds 70° C./sec, local bainite phase and martensite phase are formed, such that a microstructure becomes non-uniform and the shape becomes inferior.

It is preferable to coil the cooled steel sheet at 500 to 700° C. When cooled and coiled at less than 500° C., the bainite phase and martensite phase in the steel are formed non-uniformly and the MA phase is also formed, such that an initial microstructure is non-uniform and the shape is deteriorated. If it is coiled at a temperature higher than 700° C., a coarse ferrite phase is developed, and when there are many hardenable elements in the steel, the MA phase is formed, such that a microstructure is non-uniform and a scale layer is thickly formed on a surface layer to be peeled off in a powder form. More preferably, it is coiled at 550 to 650° C.

After the coiling, it is preferable to secondarily reheat the steel sheet to a temperature range of 850 to 1000° C. In this case, the steel sheet may be provided by the coiled-steel sheet to be cut. The secondary reheating treatment is a process for forming a martensitic matrix during cooling by phase transformation of the microstructure of the hot-rolled steel sheet into austenite. In this case, if the secondary reheating temperature is less than 850° C., it is not transformed into austenite and a residual ferrite phase is present and the strength of a final product is deteriorated. When the secondary reheating temperature exceeds 1000° C., an excessively coarse austenite phase is formed or coarse precipitates are formed, resulting in inferior impact resistance of the steel sheet.

The secondary reheating is preferably maintained for 10 to 60 minutes in the temperature range. If a holding time is less than 10 minutes, a non-transformed ferrite phase is present in the center thickness portion of the steel sheet, such that the strength is inferior, and if a holding time exceeds 60 minutes, a coarse austenite phase is formed or coarse precipitates are formed, thereby lowering the low-temperature impact resistance of the steel.

During the second reheating, it is preferable that the heating temperature (H) and the holding time (h) satisfy the condition of the following Relational expression 3.

$$R=\mathrm{Exp}(-450/(H+273))*h^{0.48},\ 20\leq R\leq 30 \quad \text{[Relational expression 3]}$$

(H is a secondary reheating temperature (° C.), h is a secondary reheating holding time (sec))

The microstructure of the steel sheet before the second reheating is a general structure having ferrite, pearlite, and fine precipitates, and the ferrite and pearlite structures in the steel during the second reheating, are transformed into an austenite phase, and the fine precipitates gradually coarsen or some alloy components are resolved such that some of the precipitate disappears. This process is mainly explained by phase transformation and diffusion of alloy components. Main influencing factors are secondary reheating temperature and time. After the second reheating heat treatment, it is preferable to satisfy the condition of the Relational expression 3 in order to have a constant size of the austenite grains of the steel. When the R value is less than 20, an non-transformed ferrite phase may be present, and when it exceeds 30, the grain size is locally exceeds 50 μm, resulting in a non-uniform structure. The R value is more preferably 25 to 30.

It is preferable to cool the secondary reheated steel sheet to a temperature of 0 to 100° C. at an average cooling rate of 30 to 100° C./sec. If a cooling stop temperature is 100° C. or less, the martensite phase is uniformly formed in an area fraction of 80% or more in a thickness direction of the steel sheet, and it is not necessary to cool below 0° C. for economic reasons. Meanwhile, when the cooling rate is less than 30° C./sec, it is difficult to form a martensite phase by 80% or more uniformly in the thickness direction of the steel sheet, and thus it is difficult to secure strength, and the impact resistance of the steel is also inferior due to the non-uniform microstructure. Meanwhile, if it is cooled exceeding 100° C./sec, the shape quality of the plate is deteriorated.

It is preferable that the cooled-steel sheet is heated to a temperature range of 100 to 500° C., and is tempering heat-treated for 10 to 60 minutes. Through the tempering heat treatment, the solid solution C in the steel is fixed to a dislocation, so that an appropriate level of yield strength can be secured. In addition, the steel sheet cooled to 100° C. or less through the cooling has a martensite phase of 80% or more, so that the tensile strength is too high and bending formability is deteriorated. Therefore, it is preferable to perform a tempering heat treatment in the temperature range. However, when it exceeds 500° C., the strength is rapidly reduced and the impact resistance of the steel is inferior due to the occurrence of temper brittleness. Particularly, when heat treatment is performed in excess of 500° C. or heat treatment for more than 60 minutes, carbides and nitrides of 0.1 μm or more are formed, which adversely affects the impact resistance of the steel. When the heat treatment is performed in the temperature range for less than 10 minutes, formability is not improved and yield strength is not sufficiently secured. When the heat treatment is performed for more than 60 minutes, tensile strength of the steel decreases and temper brittleness occurs, resulting in poor impact resistance of the steel.

It is preferable to cool the tempered heat-treated steel sheet to a temperature of 0 to 100° C. at an average cooling rate of 0.001 to 100° C./sec. The tempering heat-treated steel sheet needs to be cooled to 100° C. or lower to avoid tempering brittleness, and it is sufficient to be cooled to 0° C. or higher. In addition, in this case, if the cooling rate is 100° C./sec or less, a sufficient effect can be obtained, and when cooled to less than 0.001° C./sec, the impact resistance of the steel is deteriorated. More preferably, it is cooled to 0.01 to 50° C./sec.

MODE FOR INVENTION

Hereinafter, the present disclosure will be described in more detail through embodiments. The present disclosure is not limited to the following embodiments. This is because the scope of the present disclosure is determined by the items described in the claims and the items reasonably inferred therefrom.

Embodiment

A steel slab having an alloy composition of Tables 1 and 2 were prepared. In this case, a content of the alloy composition is weight %, and a remainder thereof includes Fe and unavoidable impurities. According to manufacturing conditions in Table 2 below, a steel sheet was manufactured.

In Table 2 below, FDT refers to a temperature during hot rolling, and CT refers to a coiling temperature. Meanwhile, a reheating temperature of the steel slab was 1250° C., a thickness of the hot-rolled steel sheet after hot rolling was 5 mm, and a cooling rate after hot rolling was adjusted to 20 to 30° C./sec, and a tempering heat treatment temperature and time were constant 350° C. and 10 minutes, respectively. Meanwhile, after the second reheating, cooling was performed to room temperature, and after tempering heat treatment, cooling was performed to room temperature at a cooling rate of 0.1° C./s.

TABLE 1

| | C | Si | Mn | Cr | Al | P | S | N | Mo | Ti | Nb | Y | B |
|---|---|---|---|---|---|---|---|---|---|---|---|---|---|
| CS1 | 0.072 | 0.03 | 1 | 0.96 | 0.03 | 0.009 | 0.003 | 0.004 | 0.23 | 0.02 | 0.015 | 0.005 | 0.001 |
| CS2 | 0.085 | 0.3 | 1.8 | 0.05 | 0.03 | 0.007 | 0.003 | 0.003 | 0.25 | 0.015 | 0.005 | 0.01 | 0.0015 |
| CS3 | 0.1 | 0.25 | 1.3 | 1.1 | 0.02 | 0.008 | 0.002 | 0.004 | 0.25 | 0.02 | 0.01 | 0.005 | 0.002 |
| CS4 | 0.09 | 0.01 | 1.8 | 0.8 | 0.03 | 0.01 | 0.003 | 0.004 | 0.05 | 0.02 | 0.005 | 0.005 | 0.0015 |
| CS5 | 0.008 | 0.5 | 1.6 | 0.5 | 0.04 | 0.006 | 0.002 | 0.003 | 0.25 | 0.03 | 0.03 | 0.05 | 0.0025 |
| CS6 | 0.11 | 0.1 | 1.5 | 0.8 | 0.04 | 0.006 | 0.002 | 0.003 | 0.15 | 0.02 | 0.025 | 0.06 | 0.002 |
| CS7 | 0.11 | 0.1 | 1.5 | 0.8 | 0.04 | 0.01 | 0.003 | 0.003 | 0.15 | 0.02 | 0.025 | 0.06 | 0.002 |
| CS8 | 0.08 | 0.02 | 1.9 | 0.6 | 0.03 | 0.01 | 0.003 | 0.003 | 0.15 | 0.02 | 0.01 | 0.006 | 0.001 |
| CS9 | 0.13 | 0.05 | 1.3 | 0.8 | 0.03 | 0.007 | 0.002 | 0.005 | 0.01 | 0.025 | 0.02 | 0.005 | 0.0015 |
| IS1 | 0.08 | 0.2 | 1.5 | 0.75 | 0.03 | 0.007 | 0.003 | 0.004 | 0.13 | 0.02 | 0.002 | 0.005 | 0.002 |
| IS2 | 0.08 | 0.4 | 1.4 | 0.7 | 0.03 | 0.009 | 0.003 | 0.0042 | 0.2 | 0.02 | 0.005 | 0.005 | 0.0015 |
| IS3 | 0.11 | 0.3 | 1.35 | 0.9 | 0.03 | 0.006 | 0.003 | 0.0035 | 0.15 | 0.022 | 0.01 | 0.005 | 0.002 |
| IS4 | 0.085 | 0.3 | 1.25 | 0.8 | 0.03 | 0.006 | 0.003 | 0.004 | 0.15 | 0.02 | 0.01 | 0.1 | 0.002 |
| IS5 | 0.082 | 0.2 | 1.4 | 0.7 | 0.03 | 0.007 | 0.003 | 0.004 | 0.1 | 0.02 | 0.01 | 0.005 | 0.0018 |

TABLE 1-continued

| | C | Si | Mn | Cr | Al | P | S | N | Mo | Ti | Nb | Y | B |
|---|---|---|---|---|---|---|---|---|---|---|---|---|---|
| IS6 | 0.083 | 0.05 | 1.5 | 0.9 | 0.03 | 0.007 | 0.003 | 0.004 | 0.25 | 0.02 | 0.005 | 0.005 | 0.0017 |
| IS7 | 0.106 | 0.1 | 1.65 | 0.9 | 0.03 | 0.006 | 0.003 | 0.003 | 0.22 | 0.025 | 0.003 | 0.004 | 0.0015 |

* IS: Inventive steel
* CS: Comparative steel

TABLE 2

| | FDT | CT | Secondary reheating temperature | | | | RE2 | | |
|---|---|---|---|---|---|---|---|---|---|
| | | | Temperature | Holding time | Cooling rate | | | | |
| | (° C.) | (° C.) | (° C.) | (sec) | (° C./sec) | RE1 | Ti* | Q | RE3 |
| CS1 | 910 | 570 | 900 | 2100 | 55 | 0.84 | 0.002 | 0.449 | 26.80 |
| CS2 | 897 | 620 | 900 | 2400 | 65 | 6.00 | 0.000 | 0.404 | 28.57 |
| CS3 | 902 | 605 | 890 | 1800 | 65 | 0.96 | 0.003 | 0.345 | 24.80 |
| CS4 | 899 | 580 | 980 | 2400 | 70 | 2.12 | 0.002 | 0.095 | 29.28 |
| CS5 | 884 | 575 | 900 | 2100 | 70 | 2.13 | 0.017 | 0.580 | 26.80 |
| CS6 | 885 | 590 | 980 | 3000 | 70 | 1.58 | 0.005 | 0.340 | 32.59 |
| CS7 | 885 | 590 | 880 | 911 | 70 | 1.58 | 0.005 | 0.340 | 17.72 |
| CS8 | 902 | 570 | 880 | 1850 | 25 | 2.38 | 0.002 | 0.352 | 25.05 |
| CS9 | 866 | 605 | 900 | 2050 | 82 | 1.60 | 0.005 | 0.048 | 26.49 |
| IS1 | 892 | 620 | 910 | 1850 | 70 | 1.70 | 0.002 | 0.227 | 25.30 |
| IS2 | 904 | 570 | 900 | 2100 | 68 | 1.56 | 0.001 | 0.339 | 26.80 |
| IS3 | 895 | 580 | 880 | 2100 | 70 | 1.29 | 0.006 | 0.205 | 26.62 |
| IS4 | 899 | 560 | 900 | 2400 | 62 | 1.32 | 0.002 | 0.255 | 28.57 |
| IS5 | 889 | 575 | 920 | 1850 | 67 | 1.75 | 0.002 | 0.461 | 25.38 |
| IS6 | 885 | 585 | 902 | 2100 | 70 | 1.30 | 0.002 | 0.404 | 26.84 |
| IS7 | 881 | 590 | 890 | 2100 | 70 | 1.47 | 0.010 | 0.296 | 26.71 |

* IS: Inventive steel
* CS: Comparative steel
* RE: Relational expression

In the Table 2, Relation expressions 1 to 3 are obtained by the following formulas.

$$T=Mn/(Cr+Mo),\ 1.0 \le T \le 3.0 \quad \text{[Relational expression 1]}$$

$$Q=(Nb/93+Ti^*/48+V/51+Mo/96)/(C/12),\ 0.2 \le Q \le 0.5$$

$$Ti^*=Ti-3.42*N-1.5*S,\ 0 \le Ti^* \le 0.02 \quad \text{[Relational expression 2]}$$

(In the Relational expressions 1 and 2, each element symbol is weight percent % of the corresponding alloy element)

$$R=Exp(-450/(H+273))*h^{0.48},\ 20 \le R \le 30 \quad \text{[Relational expression 3]}$$

(H is a secondary reheating temperature (° C.), h is a secondary reheating holding time (sec))

For the steel sheet manufactured as described above, mechanical properties of tensile strength (TS), yield strength (YS), and elongation (T-El) were measured, and Charpy V-Notched Energy (CVN) at −40° C. was measured, and a microstructure was observed, and results thereof were shown in Table 3 below.

Specifically, the tensile strength, yield strength, and elongation mean 0.2% off-set yield strength, tensile strength, and fracture elongation, and are test results obtained by taking specimens of JIS 5 standard specimens in a direction perpendicular to a rolling direction. The results of the impact tests are average values after the tests are performed three times. A Micro-Vickers hardness test at the point t/2 and t/4 positions in the thickness t direction of the steel sheet, such that a difference in hardness (ΔHv) is an average value measured 5 times.

Meanwhile, the microstructure was etched using a Nital etching method, and was based on results obtained using an optical microscope analysis result of 1000× and a scanning electron microscope of 1000× magnification, and a residual austenite phase was measured using EBSD, which was a result analyzed at 300 magnification. In Table 3 below, the number of carbonitrides represents the number of one or more of carbides and nitrides having a diameter of 0.1 μm or more per circle, observed within a unit area of 1 $cm^2$, and the number of precipitates refers to the number of precipitates having a diameter of 50 nm or more including one or more of Ti, Nb, V and Mo observed in a unit area of 1 $cm^2$. Meanwhile, in Table 3, the fraction of the microstructure refers to the area %.

TABLE 3

| | YS (MPa) | TS (MPa) | T-E1 (%) | (Δ Hv) | CVN (−40° C.) (J) | The number of carbonnitrides | The number of precipitates | Tempered martensite fraction (%) | Ferrite fraction (%) | Residual austenite fraction (%) | Tempered bainite fraction (%) |
|---|---|---|---|---|---|---|---|---|---|---|---|
| CS1 | 872 | 984 | 12 | 35 | 23 | $1.5 \times 10^2$ | $2.65 \times 10^5$ | 76 | 0 | 0 | 24 |
| CS2 | 915 | 1006 | 11 | 46 | 15 | $2.2 \times 10^2$ | $1.8 \times 10^4$ | 95 | 0 | 0 | 5 |
| CS3 | 998 | 1087 | 10 | 53 | 7 | $1.1 \times 10^2$ | $2.45 \times 10^4$ | 89 | 0 | 0 | 11 |

TABLE 3-continued

| | YS (MPa) | TS (MPa) | T-E1 (%) | (Δ Hv) | CVN (−40° C.) (J) | The number of carbonnitrides | The number of precipitates | Tempered martensite fraction (%) | Ferrite fraction (%) | Residual austenite fraction (%) | Tempered bainite fraction (%) |
|---|---|---|---|---|---|---|---|---|---|---|---|
| CS4 | 1010 | 1091 | 10 | 24 | 18 | $2.1 \times 10^2$ | $7.9 \times 10^3$ | 92 | 0 | 0 | 8 |
| CS5 | 935 | 1025 | 11 | 22 | 8 | $6.7 \times 10^2$ | $4.5 \times 10^7$ | 87 | 0 | 0 | 13 |
| CS6 | 1042 | 1145 | 9 | 18 | 11 | $7.6 \times 10^3$ | $3.8 \times 10^4$ | 96 | 0 | 0 | 4 |
| CS7 | 892 | 988 | 11 | 17 | 34 | $1.2 \times 10^2$ | $2.2 \times 10^4$ | 72 | 22 | 0 | 6 |
| CS8 | 825 | 937 | 12 | 13 | 40 | $1.3 \times 10^2$ | $4.5 \times 10^4$ | 69 | 13 | 3 | 15 |
| CS9 | 1098 | 1168 | 9 | 28 | 8 | $8.5 \times 10^3$ | $2.3 \times 10^3$ | 91 | 0 | 0 | 9 |
| IS1 | 912 | 992 | 14 | 11 | 42 | $1.2 \times 10^2$ | $2.8 \times 10^4$ | 83 | 0 | 0 | 17 |
| IS2 | 908 | 987 | 13 | 14 | 38 | $1.6 \times 10^2$ | $2.6 \times 10^4$ | 85 | 0 | 0 | 15 |
| IS3 | 982 | 1105 | 11 | 21 | 33 | $1.7 \times 10^2$ | $6.7 \times 10^4$ | 94 | 0 | 0 | 6 |
| IS4 | 945 | 1020 | 13 | 20 | 35 | $1.5 \times 10^2$ | $2.65 \times 10^5$ | 84 | 0 | 0 | 16 |
| IS5 | 913 | 995 | 13 | 15 | 45 | $1.1 \times 10^2$ | $1.8 \times 10^5$ | 88 | 0 | 0 | 12 |
| IS6 | 984 | 1084 | 11 | 22 | 36 | $1.7 \times 10^2$ | $2.4 \times 10^4$ | 92 | 0 | 0 | 8 |
| IS7 | 1028 | 1136 | 10 | 18 | 33 | $1.4 \times 10^2$ | $6.5 \times 10^4$ | 93 | 0 | 0 | 7 |

* IS: Inventive steel
* CS: Comparative steel

As can be seen from the results of Tables 1 to 3, when the conditions presented in the present disclosure are satisfied, high strength and elongation may be obtained at the same time, excellent impact resistance characteristic can be secured. For reference, no structure other than tempered martensite and tempered bainite was observed among the Inventive steels, which is interpreted as a cooling rate of the Inventive steel is 60° C./sec or higher after the secondary heat treatment. If the alloy composition is somewhat less and the cooling rate is lower than 50° C./sec, it is expected that some ferrite or residual austenite may be formed.

On the other hand, Comparative steels 1 to 3 are show cases where the Relational expression 1 of the present disclosure is not satisfied, in Comparative steels 1 to 3, an amount of tempered martensite among the microstructures was insufficient, or a difference in hardness was increased due to the difference in the microstructure by thickness position due to segregation of the thickness center portion.

Comparative steels 4 and 5 are results not satisfying the condition of Relational expression 2, and in Comparative steel 4, the austenite grains were grown non-uniformly during the secondary reheating, due to a small amount of fine precipitates formed during hot rolling, so the impact resistance was relatively poor. On the other hand, Comparative steel 5 shows a case that coarse TiN remaining in the steel increased, resulting in excessive precipitation, and the impact resistance was deteriorated due to the formation of coarse precipitate during secondary reheating.

Comparative steel 6 shows a case in which the condition of Relational expression 3 was not satisfied due to excessive secondary reheating treatment, and in Comparative steel 6, the austenite grains were non-uniform, resulting in poor impact resistance. On the other hand, Comparative Steel 7 is an opposite case of Comparative Steel 6, and in comparative Steel 7, all the microstructure of the steel sheet cannot be transformed into austenite when secondary reheating, and an non-transformed ferrite phase was present, and after final cooling, tempered martensite phase fraction in the microstructure was insufficient not to secure sufficient strength.

Comparative steel 8 was not cooled at a sufficient cooling rate after the second reheating in the manufacturing process, and a ferrite phase was formed, and finally, the tempered martensite phase fraction was insufficient, so that the target strength could not be secured. Comparative steel 9 shows a case where the range of C is out of the scope of the present disclosure, and in Comparative steel 9, it can be confirmed that high strength could be secured by a high C content and a high cooling rate, but a large amount of coarse carbides was formed during heat treatment, and the impact resistance characteristic was inferior.

Meanwhile, the distribution of the yield strength and the impact absorption energy of the Comparative steel and the Inventive steel, which are the results of Table 3, were shown in FIG. 1, and a range of Inventive steel in the present disclosure was shown in FIG. 1.

While example embodiments have been shown and described above, it will be apparent to those skilled in the art that modifications and variations could be made without departing from the scope of the present inventive concept as defined by the appended claims.

The invention claimed is:

1. A method for manufacturing steel sheet, comprises steps of:

reheating a steel slab comprising, in wt %: 0.05 to 0.12% of C, 0.01 to 0.5% of Si, 0.8 to 2.0% of Mn, 0.01 to 0.1% of A1, 0.005 to 1.2% of Cr, 0.005 to 0.5% of Mo, 0.001 to 0.01% of P, 0.001 to 0.01% of S, 0.001 to 0.01% of N, 0.001 to 0.03% of Nb, 0.005 to 0.03% of Ti, 0.001 to 0.2% of V, 0.0003 to 0.003% of B, and a remainder of Fe and unavoidable impurities;

hot rolling the reheated steel slab;

after the hot rolling, cooling the hot-rolled steel, and coiling it;

after the coiling, secondary reheating a steel sheet to a temperature of 850 to 1000° C., and maintaining the steel sheet for 10 to 60 minutes;

cooling the heated and maintained steel sheet at a cooling rate of 30 to 100° C./sec to a temperature range of 0 to 100° C.;

heating the cooled steel sheet to a temperature range of 100 to 500° C. and performing a tempering heat treatment for 10 to 60 minutes; and cooling the tempered heat-treated steel sheet at a cooling rate of 0.001 to 100° C./s to a temperature range of 0 to 100° C., wherein the steel sheet has a microstructure consisting of tempered martensite as a main structure, and a remainder of one or more of bainite, tempered bainite and ferrite.

2. The method for manufacturing the steel sheet of claim 1, wherein the secondary reheating satisfies the following Relational expression 3, $$R=\mathrm{Exp}(-450/(H+273))*h^{0.48},\ 20 \le R \le 30 \qquad \text{[Relational expression 3]}$$

(H is a secondary reheating temperature (° C.), and h is a secondary reheating holding time (sec)).

3. The method for manufacturing the steel sheet of claim 1, wherein the contents of Mn, Cr, and Mo satisfy the following Relational expression 1, $$T=Mn/(Cr+Mo),\ 1.0 \leq T \leq 3.0. \qquad \text{[Relational expression 1]}$$

4. The method for manufacturing the steel sheet of claim 1, wherein the contents of Nb, Ti, N, S, V, Mo, and C satisfy the following Relational expression 2, $$Q=(Nb/93+Ti^*/48+V/51+Mo/96)/(C/12),\ 0.2 \leq Q \leq 0.5$$

$$Ti^*=Ti-3.42*N-1.5*S,\ 0 \leq Ti^* \leq 0.02. \qquad \text{[Relational expression 2]}$$

5. The method for manufacturing the steel sheet of claim 1, wherein the reheating of the steel slab is performed in a temperature range of 1200 to 1350° C.

6. The method of manufacturing the steel sheet of claim 1, wherein the hot rolling is performed in a temperature range of 850 to 1150° C.

7. The method of manufacturing the steel sheet of claim 1, wherein cooling is performed at a cooling rate of 10 to 70° C./sec to a temperature range of 500 to 700° C. after the hot rolling.

* * * * *